US005862820A

United States Patent [19]

Kageyama et al.

[11] Patent Number: 5,862,820

[45] Date of Patent: Jan. 26, 1999

[54] BLANK MATERIAL WASHING BOOTH AND SYSTEM

[75] Inventors: Ryoichi Kageyama; Yasuyuki Sasaki, both of Sayama, Japan

[73] Assignee: Honda Giken Kogyo Kabushiki Kaisha, Tokyo, Japan

[21] Appl. No.: 935,610

[22] Filed: Sep. 23, 1997

[30] Foreign Application Priority Data

Sep. 27, 1996 [JP] Japan ..... 8-257050

[51] Int. Cl.[6] ..... B08B 3/02

[52] U.S. Cl. ..... 134/64 R; 134/122 R; 134/199; 15/309.1; 68/19.1

[58] Field of Search ..... 134/56 R, 44, 134/47, 52, 64 R, 122 R, 199; 15/309.1; 68/19.1; 137/568

[56] References Cited

U.S. PATENT DOCUMENTS

| | | | |
|---|---|---|---|
| 1,694,806 | 12/1928 | Yale . | |
| 2,504,703 | 4/1950 | Kuljian . | |
| 2,594,833 | 4/1952 | White . | |
| 2,643,616 | 6/1953 | Paxton . | |
| 3,014,488 | 12/1961 | Seaman | 134/52 |
| 3,205,910 | 9/1965 | Hatch . | |
| 3,473,480 | 10/1969 | Kollmai . | |
| 3,504,686 | 4/1970 | Cooper et al. . | |
| 3,572,381 | 3/1971 | Nash . | |
| 3,800,810 | 4/1974 | Noren | 134/52 |
| 3,885,581 | 5/1975 | Dahan et al. | 134/199 |
| 3,959,843 | 6/1976 | Yokota et al. . | |
| 4,010,514 | 3/1977 | Fischer et al. . | |
| 4,228,813 | 10/1980 | Noren . | |
| 4,281,431 | 8/1981 | Nierlich et al. . | |
| 4,357,176 | 11/1982 | Anthony | 134/47 |
| 4,415,143 | 11/1983 | Ebata | 134/122 R |
| 4,938,257 | 7/1990 | Morris | 134/108 |
| 5,054,506 | 10/1991 | Shakeri . | |
| 5,188,135 | 2/1993 | Neumann et al. | 134/122 R |
| 5,188,357 | 2/1993 | Sabatka | 134/122 R |
| 5,335,681 | 8/1994 | Schmid | 134/122 R |
| 5,464,474 | 11/1995 | Nishimoto et al. . | |
| 5,614,264 | 3/1997 | Himes | 134/199 |

FOREIGN PATENT DOCUMENTS

| | | |
|---|---|---|
| 49-37495 | 10/1974 | Japan . |
| 56-23210 | of 1981 | Japan . |
| 56-19923A | 2/1981 | Japan . |
| 7-323307 | 12/1995 | Japan . |
| 8-120474 | 5/1996 | Japan . |
| 8-120474A | 5/1996 | Japan . |

OTHER PUBLICATIONS

European Patent Office 566,831 (EPO'831), Oct. 1993.

*Primary Examiner*—Frankie L. Stinson
*Attorney, Agent, or Firm*—Merchant, Gould, Smith, Edell, Welter & Schmidt, P.A.

[57] ABSTRACT

A blank material washing booth includes a chamber for washing a blank material with a washing liquid. The chamber has a pair of upper and lower vacuum rolls for removing a used washing liquid. The washing booth also has a liquid droplet collecting device which is positioned upstream of a mist collecting device and removes a mist generated when the blank material is washed under a high pressure. The chamber has a swingable door at an inlet and an outlet for the blank material so as to achieve improved seal.

8 Claims, 5 Drawing Sheets

BLANK MATERIAL WASHING BOOTH AND SYSTEM

BACKGROUND OF THE INVENTION

1.Field of the Invention

The present invention relates to a blank material washing booth and system for washing a blank material in a path of transport for press shaping thereof.

2.Description of the Related Art

One known press shaping method comprises the steps of cutting a coiled material into blank materials of predetermined length, stacking the cut blank materials, and supplying the cut blank materials one by one to a transport path for press shaping by a press machine. Trash such as chips often adhere to the surfaces of the blank materials before pressing. When press shaping is performed with such chips adhered to the blank material surfaces, inappropriate shaping may result. It is therefore necessary to wash the blank materials before press shaping. Certain kinds of blank material washing devices are disclosed in Japanese Patent Publication No. SHO 49-37495, Japanese Patent Laid-Open Publication No. SHO 56-19923 and Japanese Utility Model Laid-Open Publication No. SHO 56-23210.

In the washing device disclosed in Japanese Patent Publication No. SHO 49-37495, trash are scratched off by a roller brush. However, the roller brush is easily worn out by contact with blank material edges and thus needs to be frequently replaced, thereby requiring high maintenance costs and tedious replacement operations. To overcome these problems, one may think of employing a steel brush which can hardly be worn out but this is inappropriate in that the blank materials may be flawed by the steel brush.

The washing devices disclosed in Japanese Patent Laid-Open Publication No. SHO 56-19923 and Japanese Utility Model Laid-Open Publication No. SHO 56-23210 are arranged such that a washing liquid is jetted from a high-pressure injector at trash on the blank materials to thereby remove the trash. However, these devices have a problem in that a suspended mist resulting from jetting the washing liquid leaks out from a washing chamber, thereby deteriorating a peripheral atmosphere.

To this end, the present inventors have proposed in Japanese Patent Laid-Open Publication No. HEI 8-120474 a "Blank Material Washing Device". The proposed device has a chamber disposed midway of a path of transport of a blank material to a pressing machine. The chamber is separated by partition walls into a front chamber positioned upstream of the transport path, a washing chamber disposed midway of the transport path, and a rear chamber disposed downstream of the transport path. The front chamber has a pair of upper and lower pinch rolls serving as feed rollers, and a mist suction port for sucking a suspended mist. The washing chamber includes a pair of washing liquid injection pipes each having a plurality of high-pressure injection or jet nozzles. The rear chamber includes a first and second pair of wringer rolls serving as wipe rollers for wiping off the washing liquid, and a mist suction port. In the proposed device, a suspended mist can be captured by a mist collector through the mist suction ports even when the washing liquid is sprayed onto the blank material under a high pressure, thereby maintaining a surrounding atmosphere in a good condition.

For sufficiently removing persistent contaminants on the blank material by using the device of Japanese Patent Laid-Open Publication No. HEI 8-120474, there is no alternative but to increase the pressure of injection of the washing liquid. However, if the injection pressure is increased, the amount of required washing liquid doubles, thereby increasing the amount of the suspended mist to be dealt with and the amount of the washing liquid to be wiped off. As a result, it becomes necessary for the wringer rolls to be provided in three- or four-stories. This imposes an increased load on the mist collector and hence requires the latter to be large-sized. Further, provision of the wringer rolls in increased stories leads to up-sizing of the washing device. Moreover, to increase the injection pressure of the washing liquid, a pump of large capacity needs to be employed, thereby increasing the cost of installation of the device.

SUMMARY OF THE INVENTION

In accordance with a first aspect of the present invention, there is provided a blank material washing booth having a chamber provided midway of a path of transport of a blank material for washing the blank material prior to pressing thereof, wherein the chamber comprises a pair of upper and lower pinch rolls for transporting the blank material in a direction of transport of the blank material while holding the blank material there-between, a plurality of injection pipes for washing the blank material by injecting a pressurized washing liquid thereagainst, a pair of upper and lower vacuum rolls for sucking a washing liquid stuck to the blank material and guiding the sucked washing liquid outwardly of the chamber, a plurality of partition walls for separating the pinch rolls from the injection pipes and the injection pipes from the vacuum rolls such that they do not obstruct passage of the blank material, and a mist discharge port for discharging a mist generated when the blank material is washed with the washing liquid.

Since the blank material washing booth in accordance with the present invention can sufficiently remove the washing liquid by the vacuum rolls, a large amount of high-pressure washing liquid can be injected from the injection pipes so that the washing capacity can be improved. Further, since the vacuum rolls have a high capacity of removing a washing liquid, compared to a conventional device in which multi-storied draining rolls (wringer rolls) are disposed, the chamber can be significantly shortened so that the washing booth is made compact.

In a preferred form, the chamber includes a blank material inlet and outlet each having a swingable door which can be push opened by passage of the blank material. With this arrangement, leakage of the mist from the inlet and outlet of the chamber can be prevented, whereby contamination of an atmosphere can be avoided and a good working environment can be maintained.

Preferably, the mist discharge port has a mist duct connected thereto, and the mist duct has a liquid droplet collecting device for removing a liquid droplet and a mist collecting device for removing a mist. With this arrangement, it becomes possible to deal with a larger quantity of the washing liquid mist compared to the case where only a mist collecting device is provided, thus enabling injection from the injection pipes of the washing liquid in a larger quantity under a higher pressure.

Each vacuum roll may be comprised of a densely apertured inner pipe and a porous cylinder covering the inner pipe so that the washing liquid can be sucked from around the porous cylinder into the inner pipe by vacuum degassing the inner pipe.

According to a second aspect of the present invention, there is provided a blank material washing system for washing a blank material with a washing liquid, comprising a blank material washing booth having a chamber for washing the blank material with the washing liquid, a blank material position detecting sensor for detecting a position of the blank material, a controller for effecting the washing of the blank material within the chamber on the basis of a signal from the sensor, a high-pressure pump for storing the washing liquid at a non-injection time and press-feeding the washing liquid to injection pipes provided within the chamber at an injection time, and an accumulator for accumulating the washing liquid at the non-injection time and feeding the washing liquid to the injection pipes and the high-pressure pump at the injection time.

The washing system in accordance with the present invention is controlled by the controller in such a manner that the washing liquid is injected from the injection pipes only when the blank material is detected by the blank material position detecting sensor. Further, since the washing system is arranged such that the high-pressure washing liquid is stored in the accumulator at a non-injection time and is fed to the injection pipes at an injection time by the accumulator and the high-pressure pump, capacity of the high-pressure pump can be reduced, whereby the installation cost can be kept to a minimum.

In this washing system, the blank material washing booth according to the first aspect of the present invention is most suitably employed.

The washing system may further comprise a dirty tank for reserving a used washing liquid recovered from the chamber, a center tank for reserving a supernatant fluid in the dirty tank, a filter for filtering the washing liquid in the center tank, and a clean tank for reserving the filtered washing liquid, whereby a clean washing liquid is press-fed to the injection pipes by the high-pressure pump and the accumulator.

BRIEF DESCRIPTION OF THE DRAWINGS

Certain preferred embodiments of the present invention will be explained in detail hereinbelow, by way of example only, with reference to the accompanying drawings, in which.

DETAILED DESCRIPTION OF THE PREFERRED EMBODIMENTS

The following description is merely exemplary in nature and is in no way intended to limit the invention or its application or uses.

The term "mist" used herein represents fine particles of a liquid. The term "liquid droplet" used herein represents a liquid particle larger than the particles forming the mist.

Figure 1:
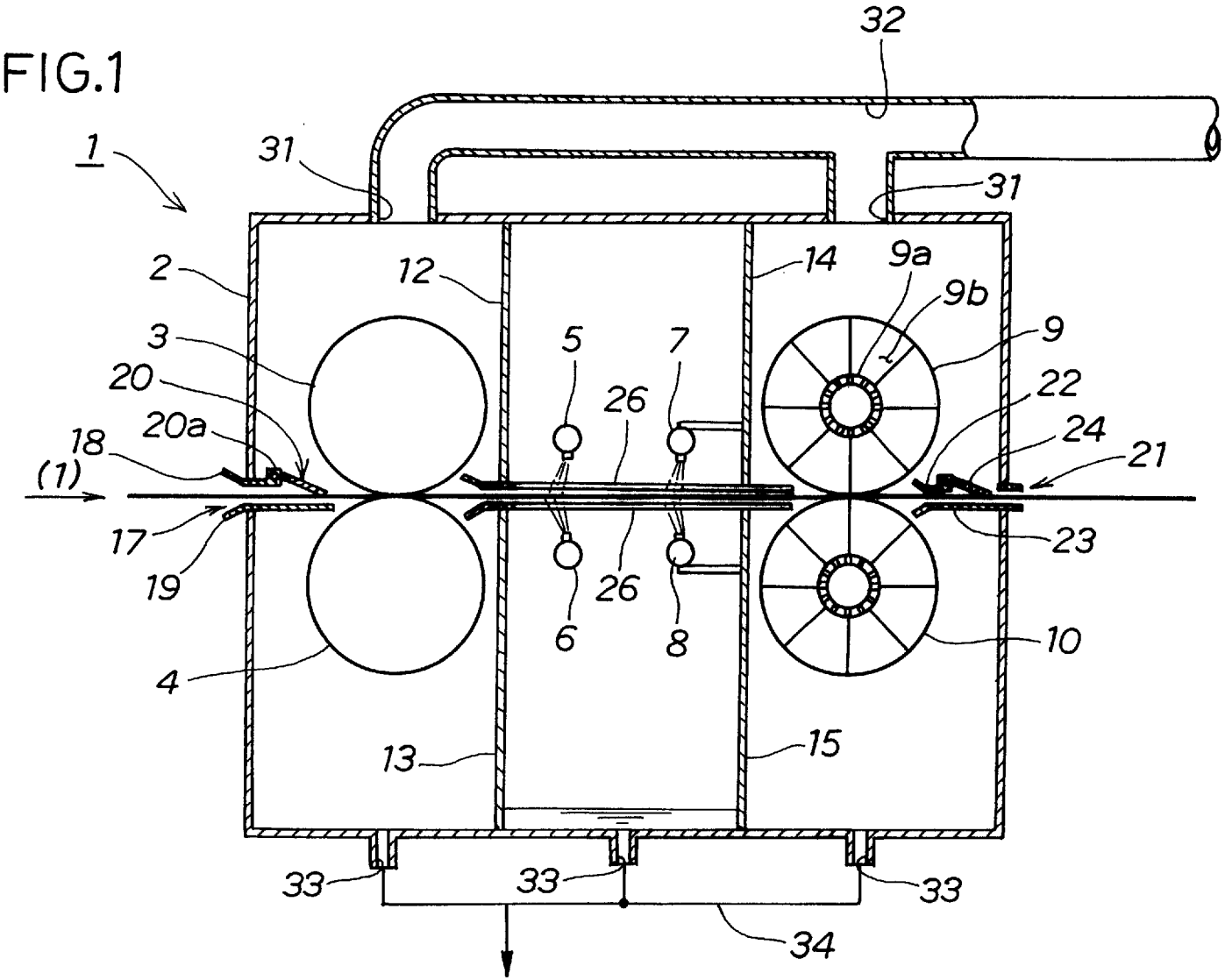
FIG. 1 is a cross sectional view schematically illustrating a blank material washing booth according to the present invention.

Referring to FIG. 1, a blank material washing booth 1 comprises a well-sealed chamber 2. In a direction of transport of a blank material (arrow (1)) within the chamber 2, there are provided upper and lower pinch rolls 3 and 4, first injection pipes 5 and 6, second injection pipes 7 and 8, and upper and lower vacuum rolls 9 and 10. The pinch rolls 3 and 4 are separated from the first pair of the injection pipes 5 and 6 by respective partition walls 12 and 13. The second injection pipes 7 and 8 are separated from the vacuum rolls 9 and 10 by respective partition walls 14 and 15. At an inlet 17 of the chamber 2, there are provided upper and lower guide plates 18 and 19 and a swingable door 20. At an outlet 21 of the chamber 2, there are provided upper and lower guide plates 22 and 23 and a swingable door 24.

The partition walls 12, 13, 14 and 15 divide the inside of the chamber 2 such that they do not obstruct the travel of the blank material.

The vacuum roll 9 is comprised of a densely apertured inner pipe 9*a*, and a porous cylinder 9*b* covering the inner pipe 9*a*. By vacuum degassing the inner pipe 9*a*, the vacuum roll 9 sucks a fluid from outside the porous cylinder 9*b* into the inner pipe 9*a*through radially extending narrow passages. The vacuum roll 10 has a similar structure.

The swingable door 20 is attached to the upper guide plate 18 by means of a pin 20*a* such that it can swing vertically. The swingable door 20 can be pushed up by the blank material but, when there is no blank material, comes down by its own weight to keep a closed state so that a mist is prevented from leaking out of the chamber 2. The swingable door 24 has a similar structure.

Guide bars 26 and 26 are provided for guiding the blank material and are in the form of a "drainboard" or "lattice" so as not to obstruct the injection of the injection pipes 5 to 8.

Reference numeral 31 denotes a mist discharge port while reference numeral 32 denotes a mist duct. Reference numeral 33 designates a washing liquid discharge port. Reference numeral 34 designates a washing liquid return pipe.

Figure 2:
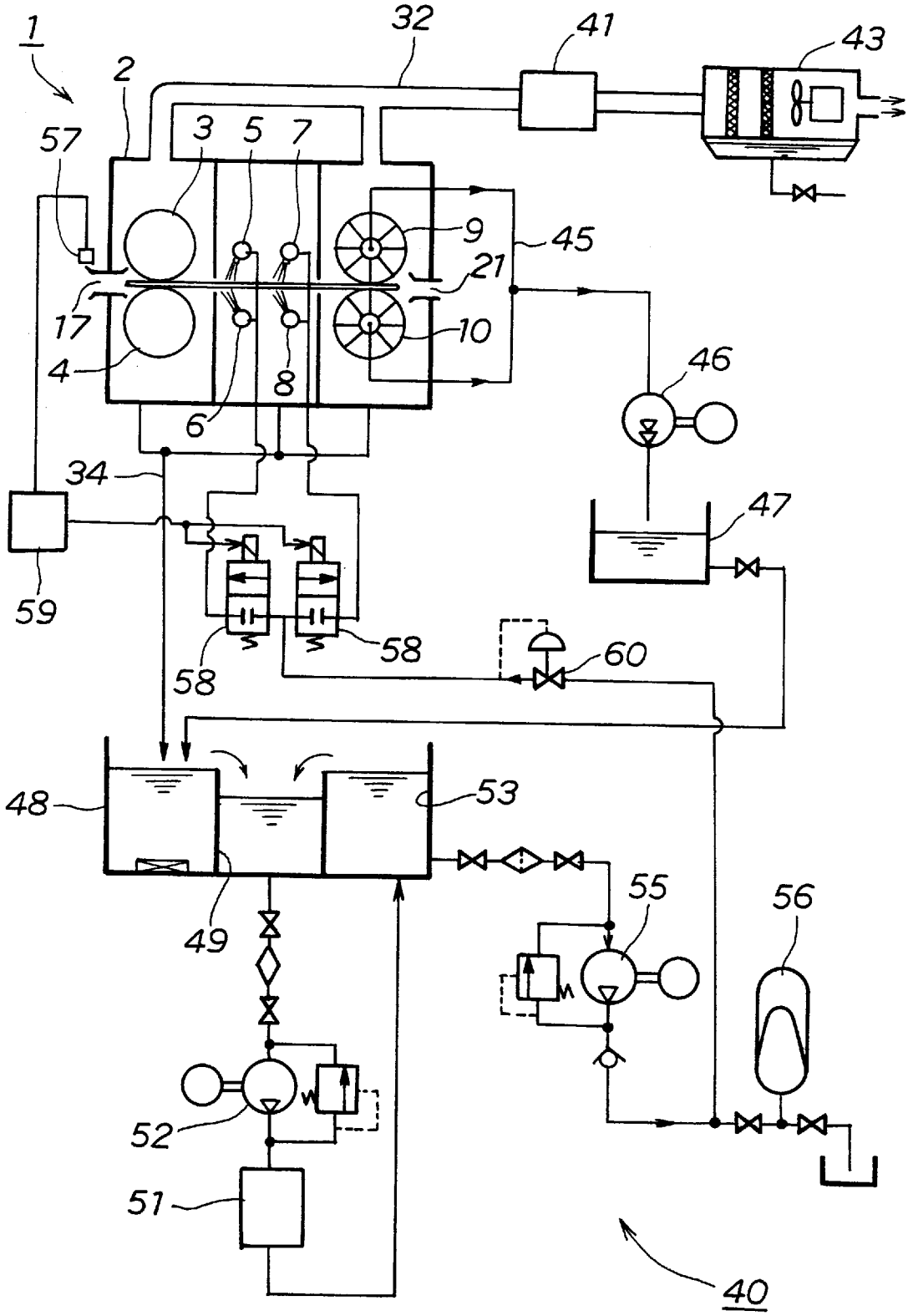
FIG. 2 is a schematic diagram of a blank material washing system according to the present invention.

Turning now to FIG. 2, a blank material washing system 40 comprises the blank material washing booth 1 explained in relation to FIG. 1, a blank material position detecting sensor 57 for detecting the position of the blank material, a controller 59 for effecting the blank material washing on the basis of a signal from the sensor 57, and an accumulator 56 for storing the washing liquid via a high-pressure pump 55 during a non-injection period and feeding the washing liquid to the injection pipes 5 to 8 in association with the high-pressure pump 55 during an injection period.

A liquid droplet collecting device 41 is provided midway of the mist duct 32. Downstream of the liquid droplet collecting device 41, there is provided a mist collecting device 43.

Connected to the vacuum rolls 9 and 10 is a vacuum pump 46 for recovering the washing liquid through a pipe 45. The washing liquid recovered by the vacuum pump 46 is collected to a drain tank 47.

A dirty tank stores the washing liquid from the drain tank 47 as well as the washing liquid from a washing liquid return pipe 34 extending downwardly from the chamber 2. A supernatant fluid of the washing liquid stored in the dirty tank 48 is stored in a center tank 49. The washing liquid in the center tank 49 is filtered by a filter 51 through a circulating pump 52. The filtered washing liquid is stored in a clean tank 53.

A clean washing liquid in the clean tank 53 is press-fed to the first and second injection pipes 5 to 8 via the high-pressure pump 55 and the accumulator 56.

The blank material position detecting sensor 57 is disposed closely to the inlet 17 of the blank material washing booth 1 for detecting the blank material. The blank material position detecting sensor 57 is connected to the controller 59 for intermittently controlling the injection of the washing liquid from the first and second injection pipes 5, 6, 7 and 8 by opening or closing solenoid valves 58 and 58 on the basis of a detecting signal thereof. Reference numeral 60 designates a pressure adjusting valve for adjusting the pressure of injection of the washing liquid.

Figure 3:
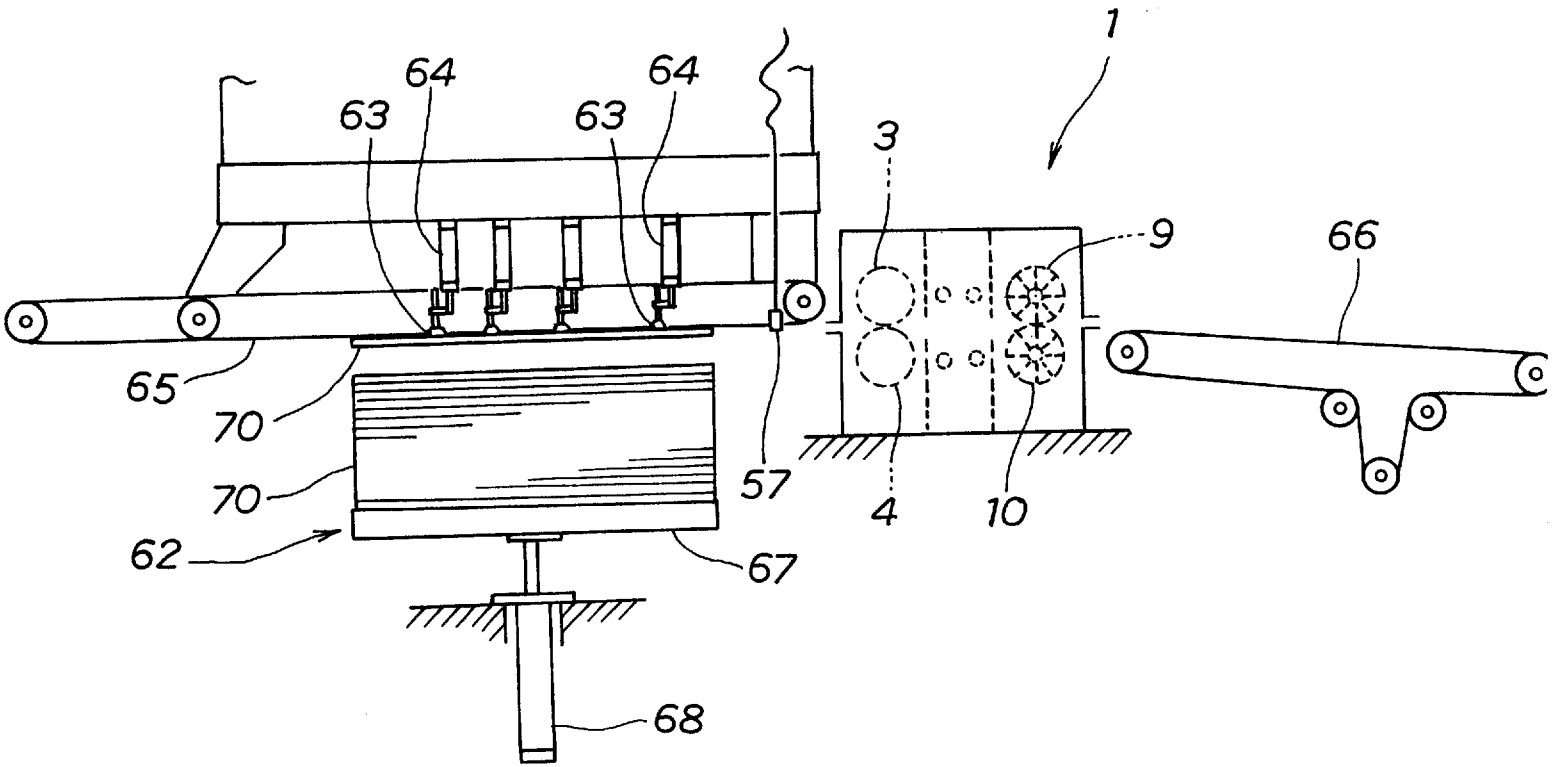
FIG. 3 diagrammatically illustrates the blank material washing booth with associated equipment disposed upstream and downstream thereof.

FIG. 3 schematically illustrates the blank material washing booth 1 and associated equipment disposed upstream and downstream thereof. Upstream of the blank material washing booth 1, there are provided a blank material stacker 62, vertically movable cup cylinders 64 each having a vacuum cup 63, an introducing magnet conveyor 65, and the blank material position detecting sensor 57. Downstream of the blank material washing booth 1, there is disposed a carry-out conveyor 66.

Next, operation of the blank material washing device just described will be explained.

Firstly, in FIG. 3, the blank materials 70 are stacked and supported on the blank material stacker 62. More specifically, the blank materials 70 are piled up on a support plate 67 by a conveyor not shown. The support plate 67 is elevated to a given level by the action of a cylinder 68.

Uppermost blank material 70 is suctioned by the plural vacuum cups 63. The suctioned blank material 70 is transported and adhered to the introducing magnet conveyor 65 by lifting the vacuum cups 63 and 63 by means of the cylinders 64 and 64.

The blank material 70 is transported to the blank material washing booth 1 by the introducing magnet conveyor 65. After it is washed within the booth 1, the blank material 70 is carried out to the downstream carry-out conveyor 66.

The introducing magnet conveyor 65, the pinch rolls 3 and 4 within the blank material washing booth 1, the vacuum rolls 9 and 10, and the carry-out conveyor 66 are continuously operated to achieve a line speed of about 120 m/min.

Turning back to FIG. 2, the blank material is pinched by the pinch rolls 3 and 4 and transported in that state. The first and second injection pipes 5, 6, 7 and 8 inject the pressurized washing liquid at the blank material to wash off dirt strongly stuck on an upper and lower surface of the blank material. A large quantity of the washing liquid used at this time is directed toward the outlet together with the blank material. The washing liquid is stopped by the vacuum rolls 9 and 10 and evacuated from the booth 1 by vacuum degassing. Accordingly, the washing liquid never leaks out from the chamber 2 through the outlet.

Thereafter, when the blank material position detecting sensor 57 detects a front or leading end of the blank material, the controller 59 calculates a time necessary for the blank material to arrive at the first injection pipes 5 and 6 on the basis of a distance from the sensor 57 to a spray area of the first injection pipes 5 and 6 and a feeding speed of the blank material, and controls the first and second injection pipes 5, 6, 7 and 8 to start the washing liquid injection, taking the above-mentioned time into consideration.

Next, when the blank material position detecting sensor 57 detects passage of a trailing end of the blank material, the controller 59 calculates a time necessary for the blank material to pass the second injection pipes 7 and 8 on the basis of a distance from the sensor 57 to an end of a spray area of the second injection pipes 7 and 8 and a feeding speed of the blank material, and controls the first and second injection pipes 5, 6, 7 and 8 to stop the washing liquid injection, taking the above-mentioned time into consideration.

Figure 4:
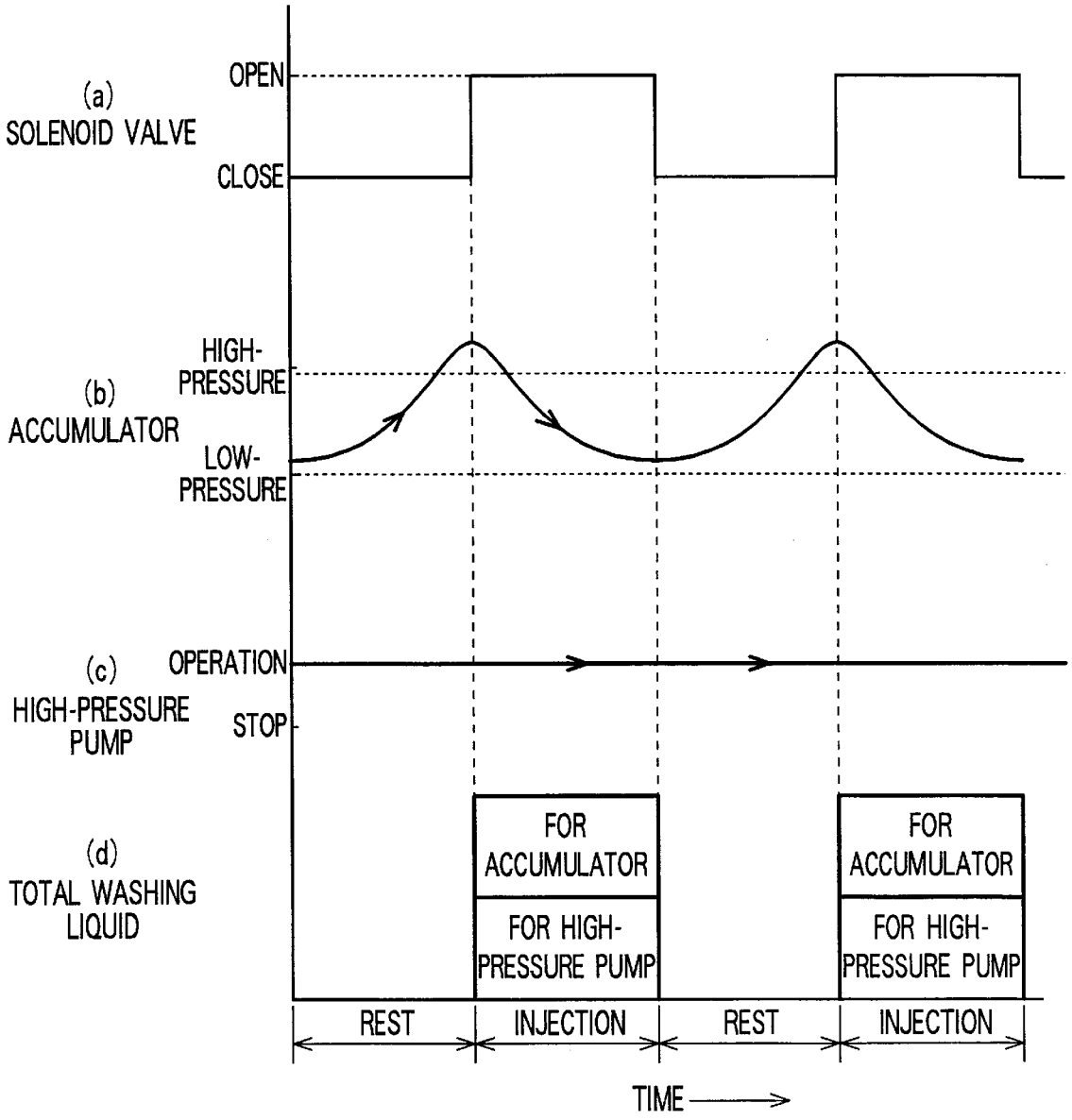
FIG. 4 is a time chart of a high-pressure pump and an accumulator.

Reference is now had to FIG. 4 showing a time chart of the high-pressure pump and the accumulator according to the present invention, wherein the axis of abscissa shows a time. Reference numerals used are those of FIG. 2.

(a) As mentioned above, the solenoid valves 58 and 58 are opened and closed by the controller 59.

(b) When the solenoid valves 58 and 58 are in a closed position, the accumulator 56 stores pressure so that an internal pressure thereof rises. When the solenoid valves 58 and 58 are in a opened position, the internal pressure of the accumulator 56 is lowered.

(c) The high-pressure pump 55 is continuously operated.

(d) As a result, the injection is performed by the total amount of the washing liquid from both the high-pressure pump and the accumulator. During an injection rest time, the washing liquid is accumulated in the accumulator via the high-pressure pump.

Accordingly, although the pressure of the washing liquid is increased, the high-pressure pump 55 may be of small capacity.

Since the pressure of the accumulator 56 is likely to become low as time lapses, the injection pressure may be kept constant by the pressure adjusting valve 60 shown in FIG. 2.

In FIG. 2, the liquid droplet collecting device 41 provided on the mist duct 32 is equipment for collecting a liquid droplet of relatively large size and may preferably be, for example, a centrifugal separating device such as a cyclone separator and an electrical separating device such as an electrical dust collector.

The cyclone separator is equipment wherein a heavy liquid droplet is caused to be struck against an inner cylinder wall thereof by a centrifugal force and to drop along the inner wall while a light air (including a mist) is collected at an upper portion thereof, thereby separating gas and liquid.

The electric separating device applies a strong electric charge to an air including a liquid droplet at an inlet thereof so as to positively (or negatively) charge the liquid droplet and adsorbs the charged liquid droplet by a negative (or positive) electrode provided within the separating device to thereby obtain only air (including little mist).

The mist collecting device 43 provided downstream of the liquid droplet collecting device 41 treats air including the mist remaining after the liquid droplet and part of the mist are removed, and may comprise a filtration paper filter. In this instance, the paper filter is replaced with reduced frequency since the remaining mist is small in amount.

In the present invention, the washing liquid having a higher pressure is used for removing persistent dirt stuck to the blank material. As a result, the amount of mist (including the liquid droplet) increases. Thus, the liquid droplet and relatively large mist are removed first by the liquid droplet collecting device 41, whereafter the remaining mist is dealt with by the mist collecting device 43. Consequently, although the amount of the mist increases, the mist removal can be carried out nicely without imparting an increased load on the mist collecting device 43.

Figure 5:
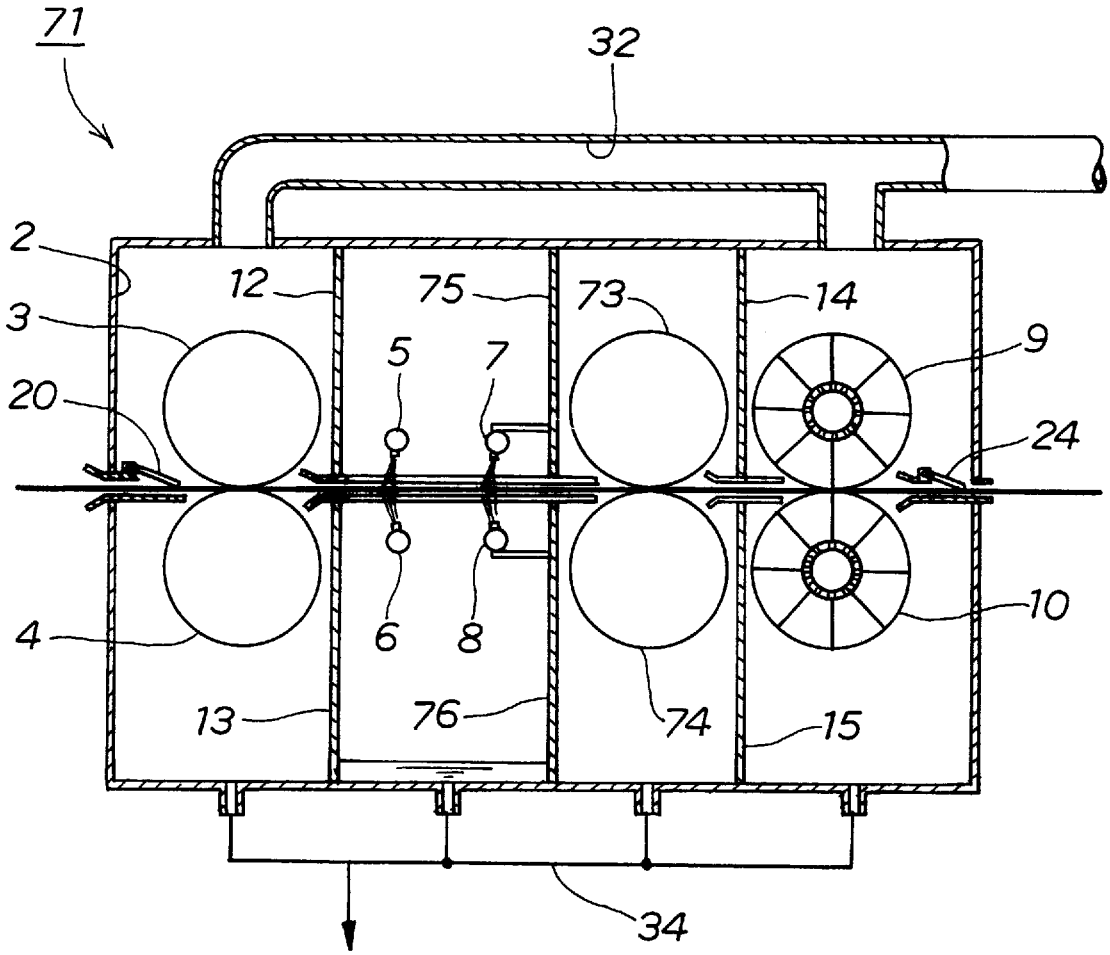
FIG. 5 is a cross sectional view schematically illustrating a blank material washing booth according to a separate embodiment of the present invention.

FIG. 5 schematically illustrates another embodiment of the blank material washing booth according to the present invention. In the blank material washing booth 71 of this embodiment, upper and lower draining rolls 73 and 74 are disposed downstream of the second injection pipes 7 and 8 of the blank material washing booth 1 shown in FIG. 1. Partition walls 75 and 76 are provided between the second injection pipes 7 and 8 and the draining rolls 73 and 74. Like reference numerals are used for corresponding parts shown in FIG. 1 and their explanation is omitted.

The blank material washing booth 71 includes the chamber 2 within which the upper and lower pinch rolls 3 and 4, the first and second injection pipes 5, 6, 7 and 8, the draining rolls 73 and 74, and the vacuum rolls 9 and 10 are disposed in order from upstream to downstream.

When the amount of the washing liquid is increased by further increasing the injection pressure of the washing liquid from the first and second injection pipes 5, 6, 7 and 8, a load on the vacuum rolls 9 and 10 also increases. Thus, advance draining is performed with respect to the blank material by the draining rolls 73 and 74, whereafter the remaining washing liquid is removed from the blank material by the vacuum rolls 9 and 10. This decreases the load on the vacuum rolls 9 and 10 and hence makes it possible to decrease the capacity of the vacuum pump.

Turning back to FIG. 2, the blank material position detecting sensor 57 may be a non-contact sensor such as a photo electrical sensor, an ultrasonic sensor, or a contact sensor such as a mechanical limit switch. Further, the blank material position detecting sensor 57 may be disposed in the chamber 2.

As thus far explained in detail, the blank material washing booth and system employing the booth according to the present invention is relatively compact while it has high capability of dealing with suspended mist and requires a pump of reduced capacity.

What is claimed is:

1. A blank material washing booth having a chamber provided midway of a path of transport of a blank material for washing the blank material prior to pressing thereof, wherein said chamber comprises:

a pair of upper and lower pinch rolls for transporting said blank material in a direction of transport of said blank material while holding said blank material therebetween;

a plurality of upper and lower injection pipes for washing said blank material by injecting a pressurized washing liquid thereagainst;

a pair of upper and lower vacuum rolls for sucking a washing liquid adhering to said blank material and guiding the sucked washing liquid outwardly of said chamber;

a plurality of partition walls for separating said pinch rolls from said injection pipes and said injection pipes from said vacuum rolls such that they do not obstruct passage of said blank material;

a mist discharge port for discharging a mist generated when said blank material is washed with said washing liquid; and said direction of transport being a direction extending between said upper and lower pinch rolls and said upper and lower vacuum rolls so that as said blank material is transported along said direction of transport, said upper and lower injection pipes washing both sides of said blank material and said partition walls separating said pinch rolls from said injection pipes and separating said vacuum rolls from said partition pipes when said blank material is being transported between said pinch rolls and passed said injection pipes and when said blank material is being transported passed said injection pipes and between said vacuum rolls.

2. A blank material washing booth according to claim 1, wherein said chamber includes a blank material inlet and outlet each having a swingable door which can be push opened by passage of said blank material.

3. A blank material washing booth according to claim 1, wherein said mist discharge port has a mist duct connected thereto, said mist duct has a liquid droplet collecting device for removing a liquid droplet and a mist collecting device for removing a mist.

4. A blank material washing booth according to claim 1, wherein each of said vacuum rolls is comprised of a densely apertured inner pipe and a porous cylinder covering said inner pipe, and wherein the washing liquid is sucked from around said porous cylinder into said inner pipe by vacuum degassing said inner pipe.

5. A blank material washing system for washing a blank material with a washing liquid, comprising:

a blank material washing booth having a chamber for washing said blank material with said washing liquid;

a blank material position detecting sensor for detecting a position of said blank material and creating a signal;

a high-pressure pump for storing the washing liquid at a non-injection time and press-feeding the washing liquid to injection pipes within said chamber at an injection time;

an accumulator for accumulating the washing liquid at the non-injection time and feeding the washing liquid to said injection pipes and said high-pressure pump at the injection time; and a controller, based on receiving the signal from said sensor, for effecting washing of said blank material during the injection time and for effecting accumulation of washing liquid in said accumulator during the non-injection time.

6. A blank material washing system according to claim 5, wherein said chamber comprises:

a pair of upper and lower pinch rolls for transporting said blank material in a direction of transport of said blank material while holding said blank material therebetween;

a plurality of injection pipes for washing said blank material by injecting a pressurized washing liquid thereagainst;

a pair of upper and lower vacuum rolls for sucking a washing liquid stuck to said blank material and guiding the sucked washing liquid outwardly of said chamber;

a plurality of partition walls for separating said pinch rolls from said injection pipes and said injection pipes from said vacuum rolls such that they do not obstruct passage of said blank material; and a mist discharge port for discharging a mist generated when said blank material is washed with said washing liquid.

7. A blank material washing system according to claim 5, further comprising:

a dirty tank for reserving a used washing liquid recovered from said chamber;

a center tank for reserving a supernatant fluid in said dirty tank;

a filter for filtering the washing liquid in said center tank; and a clean tank for reserving the filtered washing liquid, whereby a clean washing liquid is press-fed to said injection pipes by said high-pressure pump and said accumulator.

8. A blank material washing system according to claim 5, wherein said chamber includes a mist discharge port having a mist duct connected thereto, said mist duct has a liquid droplet collecting device for removing a liquid droplet and a mist collecting device for removing a mist.

* * * * *